US009214301B2

(12) United States Patent
Chen

(10) Patent No.: US 9,214,301 B2
(45) Date of Patent: Dec. 15, 2015

(54) LUMINOUS KEYBOARD DEVICE

(71) Applicant: Primax Electronics Ltd., Neihu, Taipei (TW)

(72) Inventor: Chung-Yuan Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 222 days.

(21) Appl. No.: 14/103,416

(22) Filed: Dec. 11, 2013

(65) Prior Publication Data

US 2015/0109757 A1 Apr. 23, 2015

(30) Foreign Application Priority Data

Oct. 18, 2013 (TW) ..... 102137734 U

(51) Int. Cl.
*H01H 3/12* (2006.01)
*H01H 13/83* (2006.01)

(52) U.S. Cl.
CPC ..... *H01H 13/83* (2013.01); *H01H 3/125* (2013.01); *H01H 2219/06* (2013.01); *H01H 2219/062* (2013.01)

(58) Field of Classification Search
CPC ... H01H 13/83; H01H 3/125; H01H 2219/06; H01H 2219/062; H01H 2219/0621; F21V 2200/00; F21V 2200/10; F21V 2200/13
See application file for complete search history.

(56) References Cited

U.S. PATENT DOCUMENTS 7,825,907 B2 * 11/2010 Choo ..... G06F 3/0202 345/156
7,893,374 B2 * 2/2011 Aihara ..... H01H 13/83 200/314
8,400,580 B2 * 3/2013 Park ..... G02B 6/0018 349/64
8,545,080 B2 * 10/2013 Ohrui ..... G02B 6/0043 362/23.04
2009/0128496 A1 * 5/2009 Huang ..... G06F 3/0202 345/170
2013/0235611 A1 * 9/2013 Franklin ..... G09F 13/04 362/602
2014/0204556 A1 * 7/2014 Tsai ..... H01H 13/83 362/23.03
2014/0369067 A1 * 12/2014 Chen ..... G02B 6/0021 362/606

* cited by examiner

*Primary Examiner* — Alan Cariaso
(74) *Attorney, Agent, or Firm* — Kirton McConkie; Evan R. Witt

(57) ABSTRACT

A luminous keyboard device includes a keypad module, a supporting plate, a flexible circuit board, a light-emitting element, a reflective layer, and a light guide plate. The supporting plate includes plural receiving parts. The flexible circuit board is contacted with the plural receiving parts to form plural bent structures. The light-emitting element and the reflective layer are disposed on the flexible circuit board. When a light beam is emitted by the light-emitting element, the portion of the light beam that is not directed to the light guide plate is reflected back to the light guide plate by the reflective layer on the plural bent structures. Consequently, the amount of light introduced into the light guide plate increases.

17 Claims, 10 Drawing Sheets

LUMINOUS KEYBOARD DEVICE

FIELD OF THE INVENTION

The present invention relates to a keyboard device, and more particularly to a luminous keyboard device.

BACKGROUND OF THE INVENTION

Generally, the widely-used peripheral input device of a computer system includes for example a mouse device, a keyboard device, a trackball device, or the like. Via the keyboard device, characters and symbols can be inputted into the computer system directly. As a consequence, most users and most manufacturers of input devices pay much attention to the development of keyboard devices.

FIG. 1 is a schematic top view illustrating the outer appearance of a conventional keyboard device. As shown in FIG. 1, there are plural keys 10 on a surface of the conventional keyboard device 1. These keys 10 are classified into several types, e.g. ordinary keys 101, numeric keys 102 and function keys 103. When one of these keys 10 is depressed by the user's finger, a corresponding signal is issued to the computer, and thus the computer executes a function corresponding to the depressed key. For example, when an ordinary key 101 is depressed, a corresponding English letter or symbol is inputted into the computer. When a numeric key 102 is depressed, a corresponding number is inputted into the computer. In addition, the function keys 103 (F1~F12) can be programmed to provide various functions. For example, the conventional keyboard device 1 is a keyboard device for a notebook computer.

With the maturity of the computing technologies, the keyboard manufacturers make efforts in designing novel keyboard devices with special functions in order to meet diversified requirements of different users. For this reason, a luminous keyboard device has been introduced into the market. The outer appearance of the conventional luminous keyboard device is substantially similar to the outer appearance of the conventional keyboard device 1. Since the luminous keyboard device provides the function of illuminating the keys, the inner structure of the luminous keyboard device is different from the inner structure of the keyboard device without the illuminating function. Hereinafter, the inner structure of the luminous keyboard device will be illustrated in more details. FIG. 2 is a schematic cross-sectional view illustrating a conventional luminous keyboard device. As shown in FIG. 2, the conventional luminous keyboard device 2 comprises plural keys 20, a membrane switch circuit member 21, a light guide plate 22, a backlight module 23, a supporting plate 24, a reflecting plate 25, and a base (not shown). Each key 20 comprises a keycap 201, a scissors-type connecting element 202 and an elastic element 203. From top to bottom, the keycap 201, the scissors-type connecting element 202, the elastic element 203, the membrane switch circuit member 21, the supporting plate 24, the light guide plate 22, the reflecting plate 25 and the base of the conventional luminous keyboard device 2 are sequentially shown. The backlight module 23 is located at a side of the membrane switch circuit member 22. For example, the conventional luminous keyboard device 2 is a keyboard device for a notebook computer (not shown), and the base is installed on the notebook computer.

In the key 20, the keycap 201 is exposed outside the conventional luminous keyboard device 2, so that the keycap 201 can be depressed by the user. The scissors-type connecting element 202 is used for connecting the keycap 201 and the supporting plate 24. The elastic element 203 is penetrated through the scissors-type connecting element 202. In addition, both ends of the elastic element 203 are contacted with the keycap 201 and the membrane switch circuit member 21, respectively. The membrane switch circuit member 21 comprises an upper wiring board 211, a spacer layer 212, and a lower wiring board 213. The upper wiring board 211, the spacer layer 212 and the lower wiring board 213 are all made of a light-transmissible material. The light-transmissible material is for example polycarbonate (PC) or polyethylene (PE). The upper wiring board 211 has plural upper contacts 2111. The spacer layer 212 is disposed under the upper wiring board 211, and comprises plural perforations 2121 corresponding to the plural upper contacts 2111. The lower wiring board 213 is disposed under the spacer layer 212, and comprises plural lower contacts 2131 corresponding to the plural upper contacts 2111. The plural lower contacts 2131 and the plural upper contacts 2111 are collectively defined as plural key switches 214.

The backlight module 23 comprises an illumination circuit board 231 and plural light-emitting elements 232. For clarification and brevity, only two light-emitting elements 232 are shown in the drawing. The illumination circuit board 231 is disposed under the membrane switch circuit member 21 for providing electric power to the plural light-emitting elements 232. The plural light-emitting elements 232 are disposed on the illumination circuit board 231. In addition, the plural light-emitting elements 232 are inserted into plural reflecting plate openings 251 of the reflecting plate 25 and plural light guide plate openings 221 of the light guide plate 22, respectively. By acquiring the electric power, the plural light-emitting elements 232 are driven to emit plural light beams B. Moreover, the plural light beams B are introduced into the light guide plate 22. For example, the plural light-emitting elements 232 are side-view light emitting diodes. The light guide plate 22 is used for guiding the plural light beams B to the keycaps 201. As shown in FIG. 2, the supporting plate 24 is arranged between the membrane switch circuit member 21 and the light guide plate 22 for supporting the keycap 201, the scissors-type connecting element 202, the elastic element 203 and the membrane switch circuit member 21. The reflecting plate 25 is disposed under the light guide plate 22 for reflecting the plural light beams B. Consequently, the plural light beams B are directed upwardly, and the utilization efficiency of the light beams B is enhanced. The two lateral edges 252 of the reflecting plate 25 are bent upwardly to enclose plural lateral edges 222 of the light guide plate 22. For clarification and brevity, only one lateral edge 252 of the reflecting plate 25 is shown in the drawing. Due to the lateral edges 252 of the reflecting plate 25, the problem of causing light leakage through the lateral edges 222 of the light guide plate 22 will be eliminated.

In the conventional luminous keyboard device 2, each keycap 201 has a light-outputting zone 2011. The light-outputting zone 2011 is located at a character region or a symbol region of the keycap 201. Moreover, the position of the light-outputting zone 2011 is aligned with the position of a corresponding light-guiding dot 223 of the light guide plate 22. The light beams can be guided upwardly to the light-outputting zone 2011 by the corresponding light-guiding dot 223. The supporting plate 24 comprises plural supporting plate openings 241. The plural supporting plate openings 241 are aligned with corresponding light-guiding dots 223 and corresponding light-outputting zones 2011. On the other hand, since the membrane switch circuit member 21 is made of the light-transmissible material, the plural light beams B can be transmitted through the membrane switch circuit member 21.

Consequently, after the plural light beams B are guided by the light-guiding dots 223, the plural light beams B are sequentially transmitted through the plural supporting plate openings 241 and the membrane switch circuit member 21 and directed to the plural light-outputting zones 2011, thereby illuminating the character region or the symbol region of the keycap 201. Under this circumstance, the illuminating function is achieved.

Generally, the supporting plate 24 is made of an opaque material. For example, the supporting plate 24 is made of a metallic material. Consequently, the plural light beams B are hindered by the supporting plate 24. In other words, the supporting plate 24 should have the plural supporting plate openings 241 for allowing the plural light beams B to go through.

Recently, the general trends in designing electronic devices are toward slimness, and thus the conventional luminous keyboard device needs to meet the requirements of slimness. For achieving this purpose, the manufacturers of the keyboard devices make efforts in minimizing the thickness of the luminous keyboard devices. In accordance with the conventional approach, the thicknesses of some components (e.g. the light guide plate and the light-emitting element) of the luminous keyboard device should be as small as possible. However, some drawbacks may occur. For example, the luminous efficiency of a thinner light-emitting element (e.g. the light-emitting element having a thickness smaller than 0.3 mm) is lower than a thicker light-emitting element (e.g. the light-emitting element having a thickness of 0.4 mm or 0.6 mm), and the thinner light-emitting element is more expensive than the thicker light-emitting element. In other words, the conventional luminous keyboard device with the thinner light-emitting element has reduced luminous efficiency and increased cost.

On the other hand, if a thinner light guide plate (e.g. with a thickness of 0.15 mm) and a 0.3-mm light-emitting element are employed, the height of the light-outputting surface of the light-emitting element is larger than the thickness of the light guide plate. Consequently, only a portion of the light beam emitted by the light-emitting element can be introduced into the light guide plate. The rest of the light beam is scattered away. Under this circumstance, the light utilization efficiency is insufficient.

Therefore, there is a need of providing a luminous keyboard device with reduced thickness and enhanced luminous efficiency.

SUMMARY OF THE INVENTION

An object of the present invention provides a luminous keyboard device with reduced thickness and enhanced luminous efficiency.

Another object of the present invention also provides a luminous keyboard device with enhanced light utilization efficiency.

In accordance with an aspect of the present invention, there is provided a luminous keyboard device. The luminous keyboard device includes a keypad module, a supporting plate, a flexible circuit board, at least one light-emitting element, a reflective layer, and a light guide plate. The keypad module is exposed to a top surface of the luminous keyboard device. The supporting plate is disposed under the keypad module and supports the keypad module. The supporting plate includes at least one receiving part. The flexible circuit board is disposed under the keypad module and provides electric power. The flexible circuit board is contacted with the at least one receiving part, and the flexible circuit board has at least one first bent structure corresponding to the at least one receiving part. The at least one light-emitting element is disposed on the flexible circuit board and located near the at least one receiving part. By acquiring the electric power, the at least one light-emitting element is driven to emit at least one light beam. The reflective layer is disposed on the flexible circuit board and reflects the at least one light beam. The light guide plate is disposed under the keypad module, and allows the at least one light beam to go through and guiding the at least one light beam to the keypad module. The light guide plate is thinner than each of the at least one light-emitting element. A first portion of the at least one light beam is directly introduced into the light guide plate. A second portion of the at least one light beam is reflected by the reflective layer on the at least one first bent structure and then introduced into the light guide plate.

In accordance with another aspect of the present invention, there is provided a luminous keyboard device. The luminous keyboard device includes a keypad module, a supporting plate, a flexible circuit board, at least one light-emitting element, a light guide plate, and a light-shading plate. The keypad module is exposed to a top surface of the luminous keyboard device. The supporting plate is disposed under the keypad module and supports the keypad module. The supporting plate includes at least one receiving part. The flexible circuit board is disposed under the keypad module and contacted with the keypad module. The flexible circuit board provides electric power. The at least one light-emitting element is disposed on the flexible circuit board and disposed over the at least one receiving part. By acquiring the electric power, the at least one light-emitting element is driven to emit at least one light beam. The light guide plate is arranged between the keypad module and the supporting plate, and allows the at least one light beam to go through and guide the at least one light beam to the keypad module. The light-shading plate is arranged between the keypad module and the light guide plate and contacted with the flexible circuit board. The at least one light beam is blocked by the light-shading plate. A part of the light-shading plate is in close contact with the keypad module to form at least one first bent structure corresponding to the at least one receiving part. The light guide plate is thinner than each of the at least one light-emitting element. A first portion of the at least one light beam is directly introduced into the light guide plate. A second portion of the at least one light beam is reflected by the at least one first bent structure and then introduced into the light guide plate.

The luminous keyboard device of the present invention utilizes thicker light-emitting elements. Consequently, the luminous efficiency of the light beams from the light-emitting elements will be enhanced. Moreover, the supporting plate comprises plural receiving part for accommodating the thicker light-emitting elements. The reflective layer, the light-shading plate or the reflecting plate is disposed around the light-emitting elements for reflecting the light beams that are emitted by the light-emitting elements. Consequently, the light beams can be introduced into the light guide plate and directed to the plural light-outputting zones of the keypad module. Under this circumstance, the luminous efficiency of the luminous keyboard device is slightly increased. Moreover, since the light beams emitted by the light-emitting elements are not leaked out, the light utilization efficiency is further enhanced. Moreover, the luminous keyboard device of the present invention may use a thinner light guide plate in order to meet the requirement of slimness. Moreover, the uses of the thicker light-emitting elements can increase the luminous efficiency and reduce the cost.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional luminous keyboard device, the present invention provides an improved luminous keyboard device.

Figure 1:
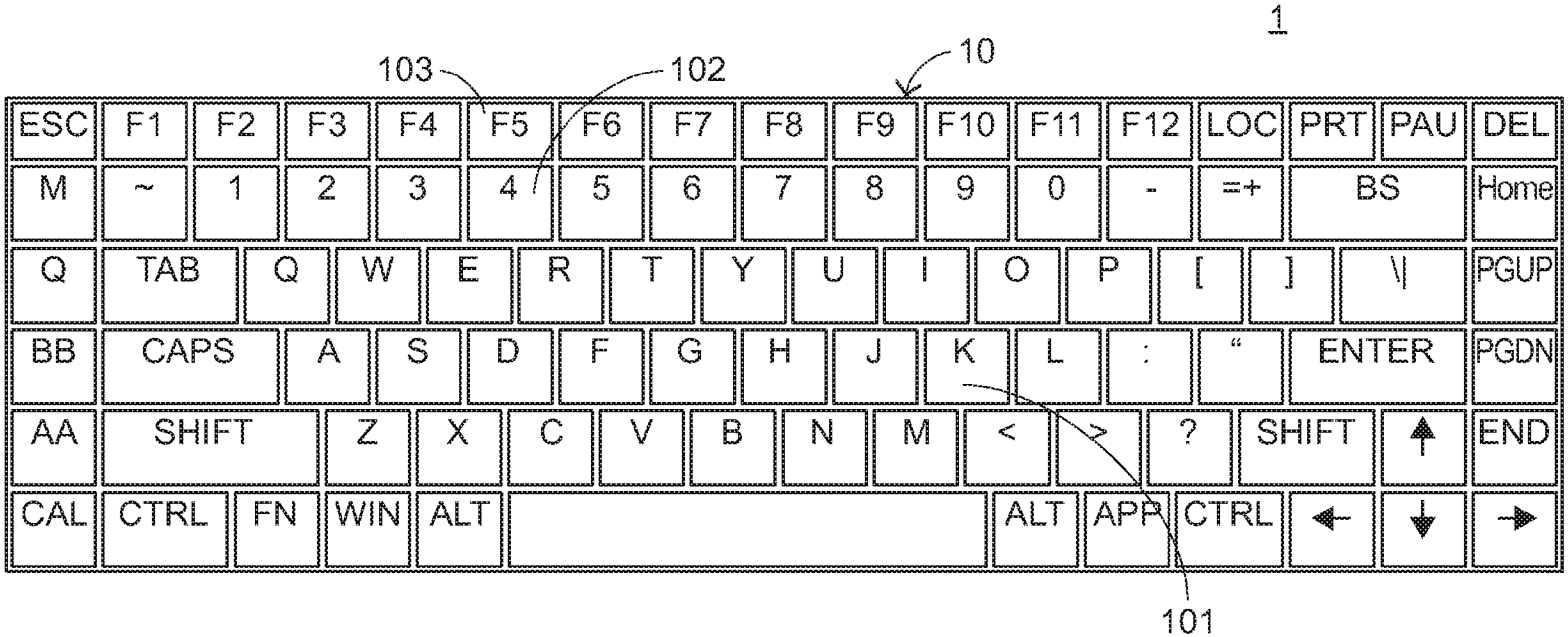
FIG.1 PRIOR ART
FIG. 1 is a schematic top view illustrating the outer appearance of a conventional keyboard device.
Figure 2:
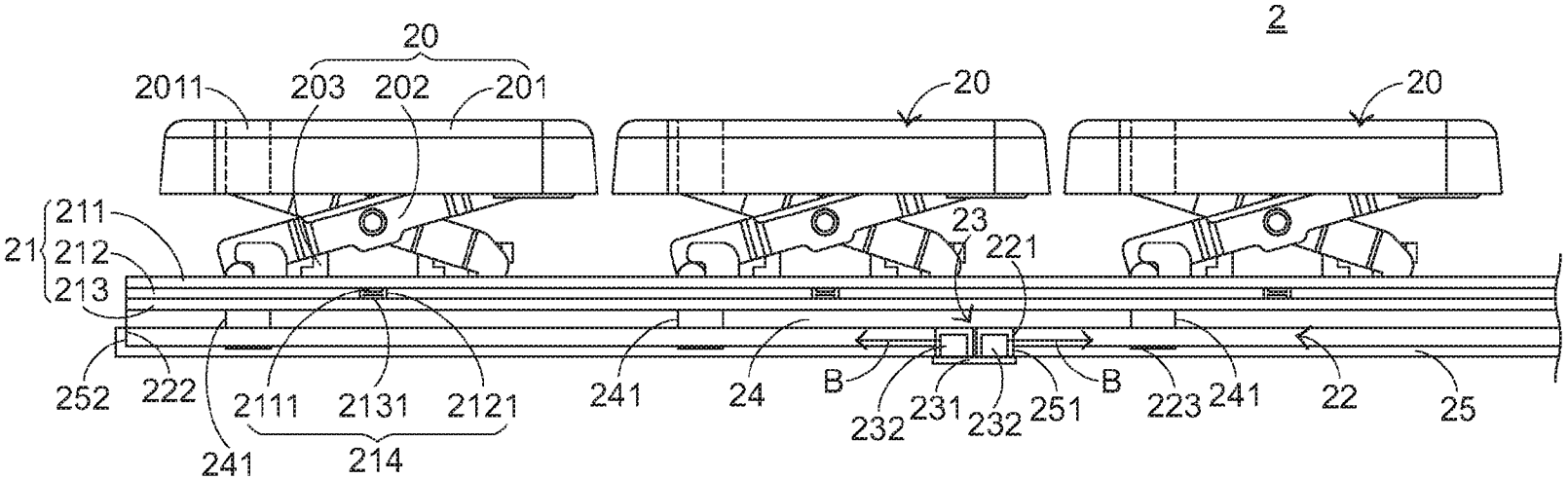
FIG.2 PRIOR ART
FIG. 2 is a schematic cross-sectional view illustrating a conventional luminous keyboard device.
Figure 3:
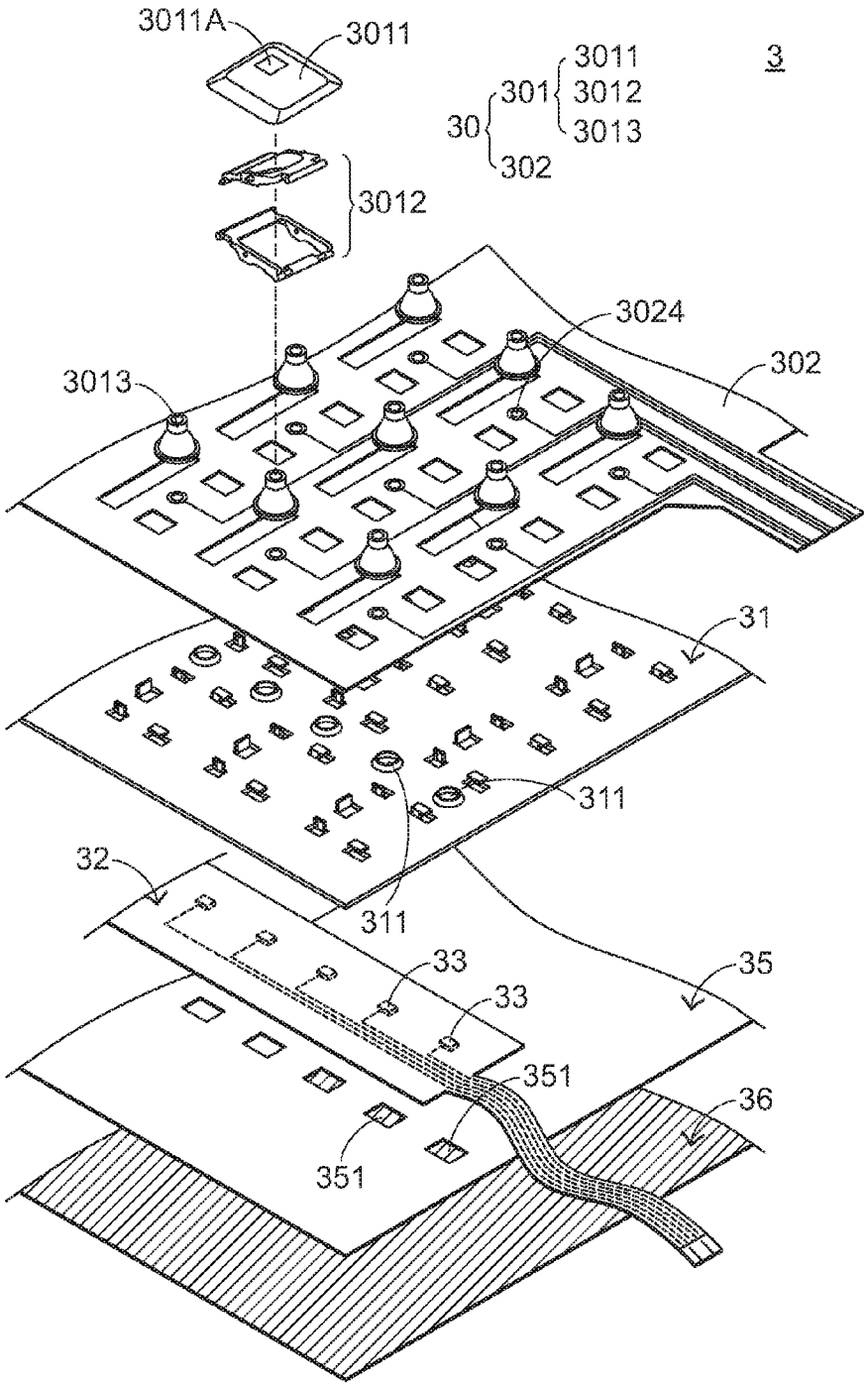
FIG. 3 is a schematic exploded view illustrating a portion of a luminous keyboard device according to a first embodiment of the present invention.
Figure 4:
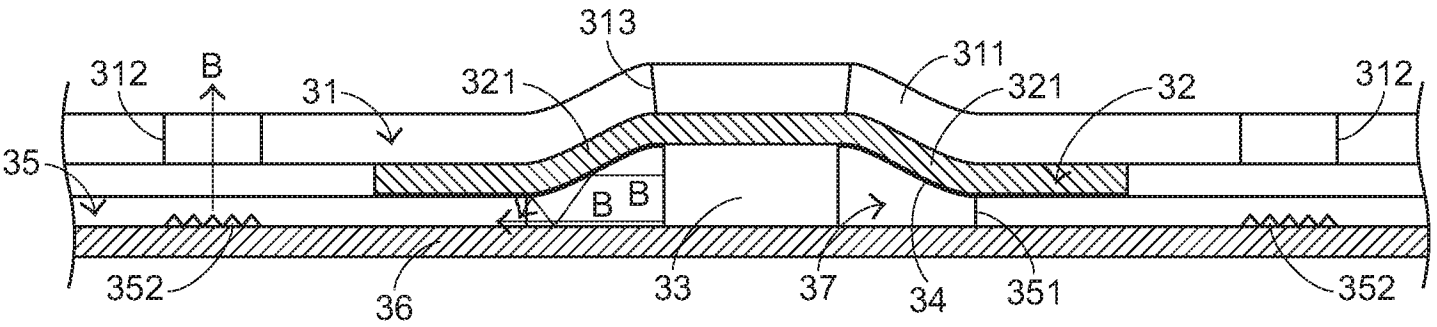
FIG. 4 is a schematic partial cross-sectional view illustrating the luminous keyboard device according to the first embodiment of the present invention.

FIG. 3 is a schematic exploded view illustrating a portion of a luminous keyboard device according to a first embodiment of the present invention. FIG. 4 is a schematic partial cross-sectional view illustrating the luminous keyboard device according to the first embodiment of the present invention. As shown in FIGS. 3 and 4, the luminous keyboard device 3 comprises a keypad module 30, a supporting plate 31, a flexible circuit board 32, plural light-emitting elements 33, a reflective layer 34, a light guide plate 35, and a reflecting plate 36. The keypad module 30 is partially exposed to a top surface of the luminous keyboard device 3. Moreover, the keypad module 30 comprises plural keys 301 and a switch circuit member 302. The plural keys 301 are partially exposed outside the top surface of the luminous keyboard device 3. The switch circuit member 302 is arranged between the supporting plate 31 and the plural keys 301. When the switch circuit member 302 is triggered by the plural keys 301, plural key signals are correspondingly generated.

In the keypad module 30, each of the keys 301 comprises a keycap 3011, a connecting element 3012, and an elastic element 3013. The keycap 3011 is exposed outside the top surface of the luminous keyboard device 3, so that the keycap 3011 can be depressed by the user. Each keycap 3011 has a light-outputting zone 3011A. The light-outputting zone 3011A is located at a character region or a symbol region of the keycap 3011. The connecting element 3012 is arranged between the supporting plate 31 and the keycap 3011. The connecting element 3012 is used for connecting the supporting plate 31 and the keycap 3011 and allowing the keycap 3011 to be moved upwardly or downwardly relative to the supporting plate 31. The elastic element 3013 is disposed under the keycap 3011 for providing an elastic force to the keycap 3011. In response to the elastic force, the keycap 3011 is moved upwardly and returned to its original position. In this embodiment, the luminous keyboard device 3 is a keyboard device for a notebook computer (not shown). Moreover, the connecting element 3012 is a scissors-type connecting element (also referred as a scissors leg structure) that is swung with the movement of the keycap 3011. The elastic element 3013 is a light-transmissible rubbery elastomer.

Figure 5:
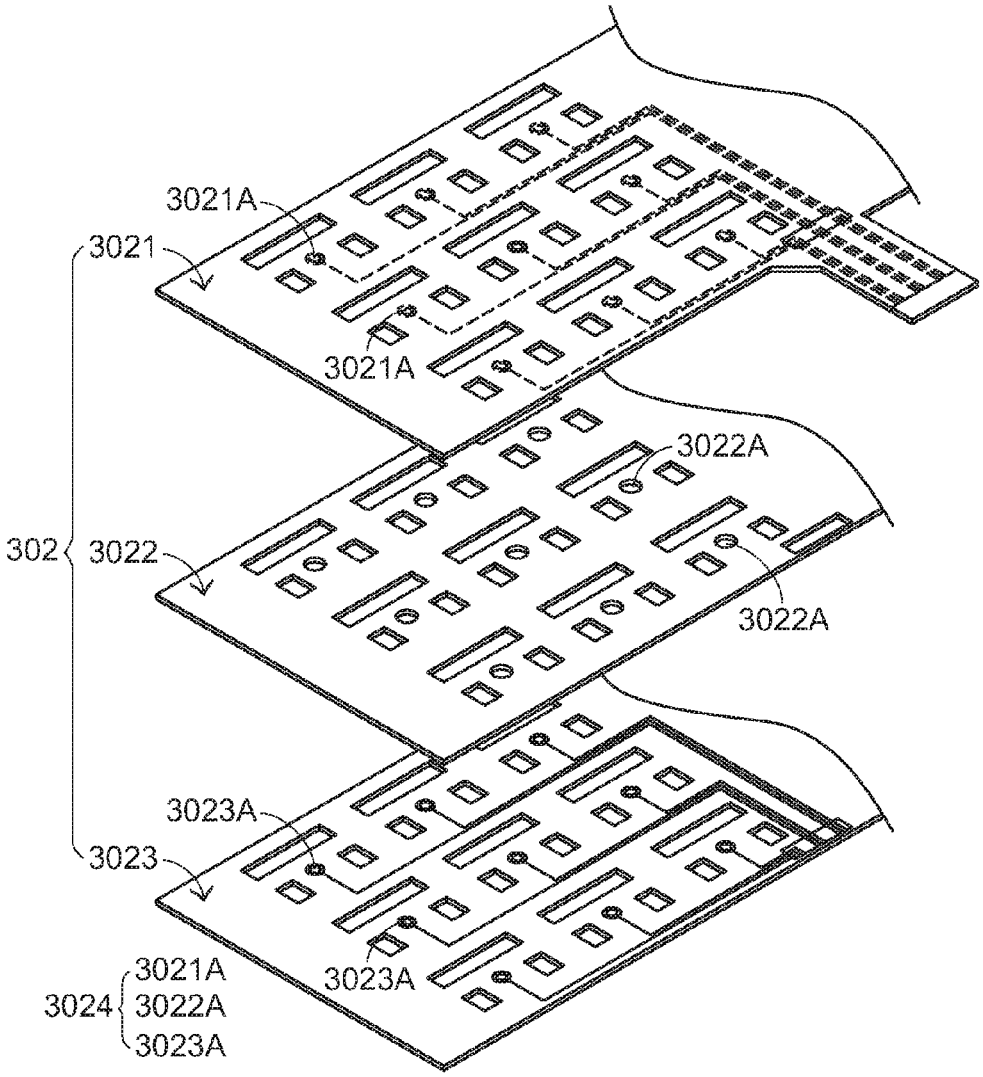
FIG. 5 is a schematic exploded view illustrating the switch circuit member of the luminous keyboard device according to the first embodiment of the present invention.

The structure of the switch circuit member 302 will be illustrated in more details as follows. FIG. 5 is a schematic exploded view illustrating the switch circuit member of the luminous keyboard device according to the first embodiment of the present invention. In this embodiment, the switch circuit member 302 comprises an upper wiring board 3021, a spacer layer 3022 and a lower wiring board 3023. The upper wiring board 3021 has plural upper contacts 3021A. The spacer layer 3022 is disposed under the upper wiring board 3021. Moreover, the spacer layer 3022 comprises plural perforations 3022A corresponding to the plural upper contacts 3021A. The lower wiring board 3023 is disposed under the spacer layer 3022. Moreover, the lower wiring board 3023 comprises plural lower contacts 3023A corresponding to the plural upper contacts 3021A. The plural upper contacts 3021A, the plural perforations 3022A and the plural lower contacts 3023A are collectively defined as plural key switches 3024. When the switch circuit member 302 is pressed by the elastic element 3013, a corresponding upper contact 3021A is inserted into the corresponding perforation 3022A and contacted with the corresponding lower contact 3023A. Consequently, a key signal is correspondingly generated. In this embodiment, the switch circuit member 302 is a membrane switch circuit member.

Please refer to FIGS. 3 and 4 again. The supporting plate 31 is disposed under the switch circuit member 302 for supporting the keypad module 30. Moreover, the supporting plate 31 comprises plural receiving parts 311. The flexible circuit board 32 is disposed under the supporting plate 31, and disposed over the light guide plate 35. The flexible circuit board 32 is used for providing electric power to the plural light-emitting elements 33, thereby driving the plural light-emitting elements 33. The flexible circuit board 32 is contacted with the plural receiving parts 311. Consequently, the flexible circuit board 32 has plural bent structures 321 corresponding to the plural receiving parts 311, respectively. The plural light-emitting elements 33 are disposed on a bottom surface of the flexible circuit board 32 and located near the plural receiving parts 311. By acquiring the electric power, the plural light-emitting elements 33 are driven to emit plural light beams B. The reflective layer 34 is disposed on the bottom surface of the flexible circuit board 32 for reflecting the plural light beams B. In this embodiment, the supporting plate 31 is made of a metallic material. The light-emitting element 33 is a large-sized side-view light emitting diodes (e.g. the side-view light emitting diode having a thickness of 0.4 mm). Moreover, the reflective layer 34 is formed on the bottom surface of the flexible circuit board 32 by coating a reflective material.

The light guide plate 35 is disposed under the flexible circuit board 32 for allowing the plural light beams B to go through and guide the plural light beams B to be directed upwardly to the keypad module 30. Consequently, the plural light beams B are guided to the plural light-outputting zones 3011A of the plural keycaps 3011 to achieve the illuminating function. The light guide plate 35 comprises plural first openings 351 and plural light-guiding structures 352. The plural first openings 351 are formed in the light guide plate 35, and aligned with the plural receiving parts 311, respectively. The plural first openings 351 and the plural receiving parts 311 are collaboratively defined as plural receiving spaces 37 for accommodating the plural light-emitting elements 33. For clarification and brevity, only one receiving space 37 is shown in FIG. 4. The plural light-guiding structures 352 are formed on a bottom surface of the light guide plate 35 for guiding the plural light beams B to the plural light-outputting zones 3011A of the plural keycaps 3011. Moreover, the supporting plate 31 comprises plural second openings 312. The plural second openings 312 are formed in the supporting plate 31, and aligned with the plural light-guiding structures 352, respectively. After the plural light beams B guided by the plural light-guiding structures 352 are transmitted through the plural second openings 312, the plural light beams B are directed to the plural light-outputting zones 3011A.

The reflecting plate 36 is disposed under the light guide plate 35 for reflecting the portions of the plural light beams B that are not introduced into the light guide plate 35. Consequently, the reflected portions of the plural light beams B are introduced into the light guide plate 35 again. In this embodiment, the light guide plate 35 is a thinner light guide plate with a thickness of about 0.15 mm. Moreover, the light-guiding structures 352 are V-cut microstructures.

After the supporting plate 31, the flexible circuit board 32, the plural light-emitting elements 33, the reflective layer 34, the light guide plate 35 and the reflecting plate 36 are combined together, the resulting structure of the luminous keyboard device is shown in FIG. 4. The plural light-emitting elements 33 are inverted and disposed on a bottom surface of the flexible circuit board 32. For clarification and brevity, only one light-emitting element 33 is shown in FIG. 4. Moreover, the thickness of the light guide plate 35 (0.15 mm) is smaller than the thickness of the light-emitting element 33 (0.4 mm). Each of the plural receiving parts 311 comprises a protrusion structure with a third opening 313. For clarification and brevity, only one receiving part 311 is shown in FIG. 4. In this embodiment, a method of producing the receiving part 311 comprises a hole-breaking step of creating the third opening 313 and a stamping step of forming an upward convex structure around the third opening 313.

The operating principles of depressing the keycaps 3011 to trigger the switch circuit member 302 to generate the key signals are well known to those skilled in the art, and are not redundantly described herein. The illumination of the luminous keyboard device 3 will be illustrated as follows. Please refer to FIG. 4. When the luminous keyboard device 3 is driven and thus enabled, the plural light-emitting elements 33 emit the plural light beams B. The first portions of the plural light beams B are directly introduced into the light guide plate 35, and then guided by the plural light-guiding structures 352 of the light guide plate 35 to be directed upwardly. After the first portions of the plural light beams B are departed from the light guide plate 35, the first portions of the plural light beams B are sequentially transmitted through the plural second openings 312 of the supporting plate 31, the light-transmissible switch circuit member 302 and the light-transmissible elastic element 3013, and then directed to the plural light-outputting zones 3011A of the plural keycaps 3011. Consequently, the illuminating function is achieved. On the other hand, the second portions of the plural light beams B are directed to the flexible circuit board 32, reflected by the reflective layer 34 on the bent structure 321, and then introduced into the light guide plate 35. Then, the second portions of the plural light beams B are sequentially transmitted through the plural second openings 312, the switch circuit member 302 and the elastic element 3013, and directed to the plural light-outputting zones 3011A. The third portions of the plural light beams B are directed to the reflecting plate 36, and reflected back to the light guide plate 35 by the reflecting plate 36. Similarly, the third portions of the plural light beams B are sequentially transmitted through the plural second openings 312, the switch circuit member 302 and the elastic element 3013, and directed to the plural light-outputting zones 3011A.

Due to the arrangement of the reflective layer 34 and the reflecting plate 36, the portions of the plural light beams B that are not directed to the light guide plate 35 are reflected back into the light guide plate 35. Since the plural light beams B from the plural light-emitting elements 33 are all introduced into the light guide plate 35 and directed to the plural light-outputting zones 3011A, the utilization efficiency of the light beams B is enhanced. Consequently, the luminous keyboard device has a reduced thickness while achieving enhanced luminous efficiency and high light utilization efficiency.

The following three aspects will be specially described. Firstly, the bending angles of the plural bent structures 321 of the flexible circuit board 32 are determined according to the extents of rising the plural receiving parts 311, and the reflection angle of the reflective layer 34 is determined according to the bending angles of the plural bent structures 321. That is, the reflection angle of the reflective layer 34 may be adjusted by changing the extents of rising the plural receiving parts 311 according to practical requirements. Secondly, five light-emitting elements 33 are shown in FIG. 3. The directions of projecting the light beams B from these light-emitting elements 33 may be different. For example, the light projecting directions may be alternately changed. For example, the first light-emitting element 33 (i.e. the rightmost light-emitting element as shown in FIG. 3) projects the light beams B in a left direction of FIG. 3; the second light-emitting element 33 (i.e. the light-emitting element next to the first light-emitting element 33) projects the light beams B in a right direction of FIG. 3; the third light-emitting element 33 (i.e. the middle light-emitting element as shown in FIG. 3) projects the light beams B in the left direction of FIG. 3; the fourth light-emitting element 33 (i.e. the light-emitting element next to the third light-emitting element 33) projects the light beams B in the right direction of FIG. 3; and the fifth light-emitting element 33 (i.e. the leftmost light-emitting element as shown in FIG. 3) projects the light beams B in the left direction of FIG. 3. Thirdly, the supporting plate 31 is made of a metallic material with high reflectivity. Consequently, the supporting plate 31 has the function of reflecting light. After the plural light beams B are departed from the light guide plate 35, the plural light beams B can be reflected back to the light guide plate 35 by the supporting plate 31. Under this circumstance, the utilization efficiency of the light beams B is further enhanced.

Figure 6:
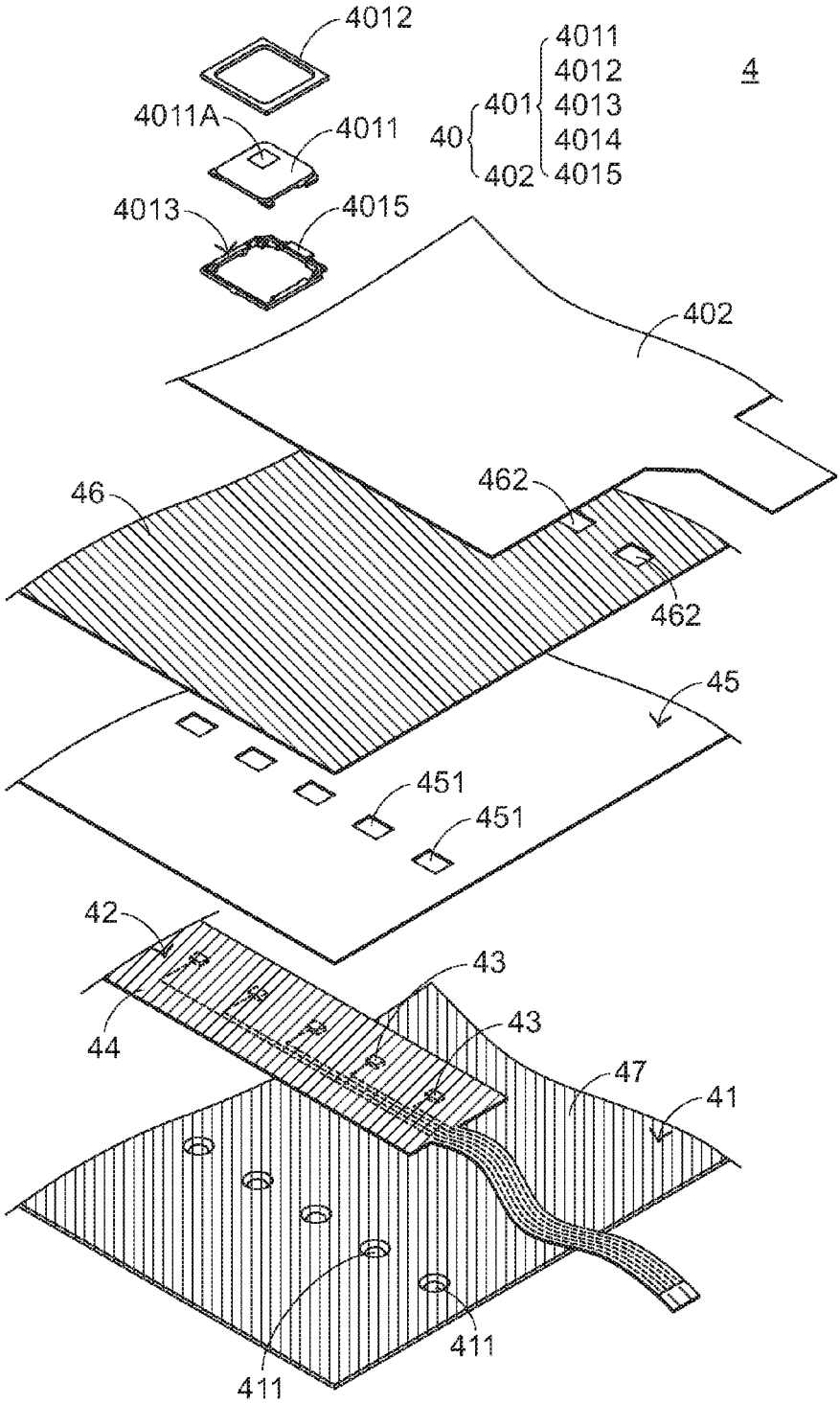
FIG. 6 is a schematic exploded view illustrating a portion of a luminous keyboard device according to a second embodiment of the present invention.
Figure 7:
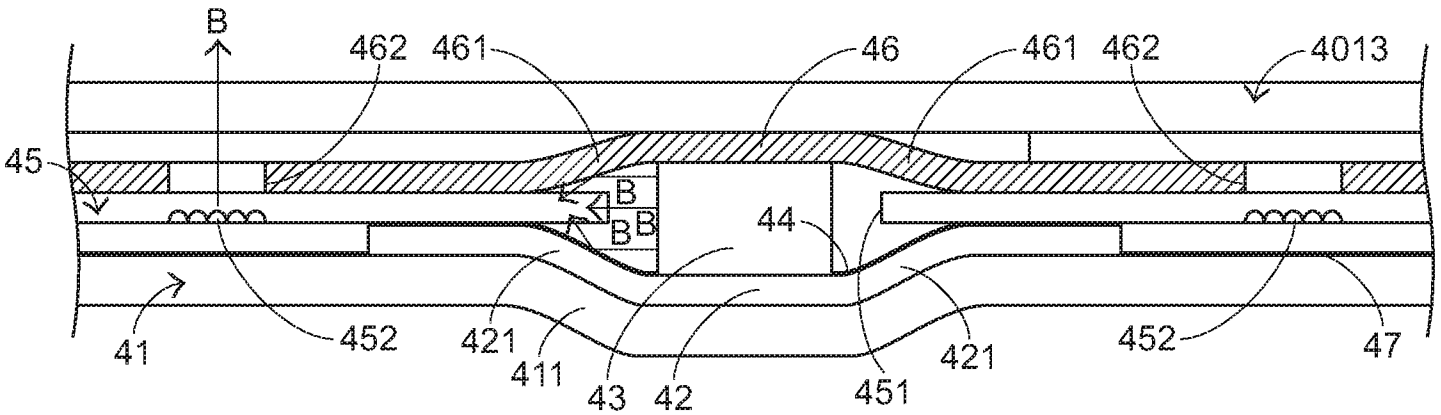
FIG. 7 is a schematic partial cross-sectional view illustrating the luminous keyboard device according to the second embodiment of the present invention.

The present invention further provides a luminous keyboard device according to a second embodiment of the present invention. FIG. 6 is a schematic exploded view illustrating a portion of a luminous keyboard device according to a second embodiment of the present invention. FIG. 7 is a schematic partial cross-sectional view illustrating the luminous keyboard device according to the second embodiment of the present invention. As shown in FIGS. 6 and 7, the luminous keyboard device 4 comprises a keypad module 40, a supporting plate 41, a flexible circuit board 42, plural light-emitting elements 43, a first reflective layer 44, a light guide plate 45, a light-shading plate 46, and a second reflective layer 47. The supporting plate 41 comprises plural receiving parts 411 corresponding to the plural light-emitting elements 43. The flexible circuit board 42 comprises plural bent structures 421. The light guide plate 45 comprises plural first openings 451 and plural light-guiding structures 452.

Except for the following four items, the structures and the operations of the luminous keyboard device 4 of this embodiment are substantially identical to those of the luminous keyboard device 3 of the first embodiment, and are not redundantly described herein.

In accordance with a first distinguished item, the structure of the keypad module 40 of this embodiment is distinguished from the keypad module 30 of the first embodiment. The keypad module 40 is partially exposed to a top surface of the luminous keyboard device 4. Moreover, the keypad module 40 comprises plural keys 401 and a switch circuit member 402. The plural keys 401 are partially exposed outside the top surface of the luminous keyboard device 4. The switch circuit member 402 is disposed under the plural keys 401. When the switch circuit member 402 is triggered by the plural keys 401, plural key signals are correspondingly generated. In the keypad module 40, each of the keys 401 comprises a keycap 4011, a frame body 4012, a connecting element 4013, a first magnetic element 4014, and a second magnetic element 4015. The keycap 4011 is exposed outside the top surface of the luminous keyboard device 4, so that the keycap 4011 can be depressed by the user. Each keycap 4011 has a light-outputting zone 4011A. The frame body 4012 is contacted with the keycap 4011 for stopping the keycap 4011, thereby preventing detachment of the keycap 4011 from the frame body 4012. The connecting element 4013 is disposed under the frame body 4012 and contacted with the keycap 4011 for allowing the keycap 4011 to be moved upwardly or downwardly relative to the frame body 4012. The switch circuit member 402 is disposed under the connecting element 4013. When the switch circuit member 402 is triggered by the plural keys 401, plural key signals are correspondingly generated.

Figure 8:
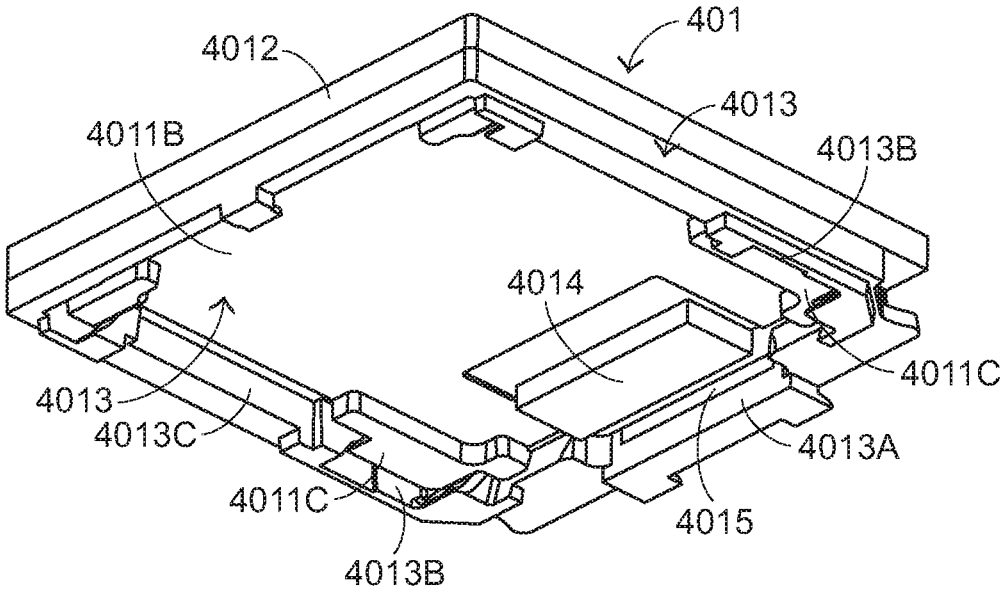
FIG. 8 is a schematic partial perspective view illustrating the keycap, the frame body and the connecting element of the luminous keyboard device according to the second embodiment of the present invention.

Hereinafter, the relationships between the keycap 4011, the frame body 4012 and the connecting element 4013 will be illustrated with reference to FIGS. 6 and 8. FIG. 8 is a schematic partial perspective view illustrating the keycap, the frame body and the connecting element of the luminous keyboard device according to the second embodiment of the present invention. In FIG. 8, the structures of the keycap 4011, the frame body 4012 and the connecting element 4013 are shown. The first magnetic element 4014 is disposed on a bottom surface 4011B of the keycap 4011, and located at a first side of the keycap 4011. The second magnetic element 4015 is disposed on a first sidewall 4013A of the connecting element 4013, and located near the first magnetic element 4014. The first magnetic element 4014 and the second magnetic element 4015 are magnetically attracted by each other so as to generate a magnetic force. In response to the magnetic force, the keycap 4011 is returned to its original position. On the other hand, the keycap 4011 further comprises plural bulges 4011C. The plural bulges 4011C are located at a second side of the keycap 4011. The second side of the keycap 4011 is different to the first side where the first magnetic element 4014 is located. The connecting element 4013 further comprises plural inclined guiding recesses 4013B. The plural inclined guiding recesses 4013B are formed in a second sidewall 4013C of the connecting element 4013, and aligned with the plural bulges 4011C, respectively. The plural inclined guiding recesses 4013B are contacted with the plural bulges 4011C, respectively. Moreover, when the plural bulges 4011C are moved within respective inclined guiding recesses 4013B, the keycap 4011 is moved upwardly and downwardly relative to the frame body 4012. Since the top side of the connecting element 4013 is covered by the frame body 4012, the keycap 4011 is permitted to be moved within the range between the frame body 4012 and the connecting element 4013 without being detached from the frame body 4012. In this embodiment, the luminous keyboard device 4 is a magnetic keyboard device. The connecting element 4013 is a guide array that supports the keycap 4011 but is not swung with the movement of the keycap 4011. Both of the first magnetic element 4014 and the second magnetic element 4015 are magnets. The plural bulges 4011C are integrally formed with the keycap 4011. The switch circuit member 402 is a capacitive sensing circuit.

The actions of the keypad module 40 after the keycap 4011 is depressed will be illustrated briefly as follows. In case that the keycap 4011 is not depressed by the user, the first magnetic element 4014 on the keycap 4011 is magnetically attracted by the second magnetic element 4015 on the connecting element 4013. When the keycap 4011 is depressed by the user and the depressing force on the keycap 4011 is larger than the magnetic force generated by the first magnetic element 4014 and the second magnetic element 4015, the plural bulges 4011C of the keycap 4011 are moved from first ends (i.e. the upper ends as shown in FIG. 8) of the corresponding inclined guiding recesses 4013B to second ends (i.e. the lower ends as shown in FIG. 8) of the corresponding inclined guiding recesses 4013B. That is, the keycap 4011 is moved downwardly relative to the frame body 4012. At the same time, the switch circuit member 402 under the connecting element 4013 detects that the first magnetic element 4014 is approaching. Consequently, the switch circuit member 402 is triggered to generate a corresponding key signal. When the keycap 4011 is no longer depressed by the user, the magnetic force generated by the first magnetic element 4014 and the second magnetic element 4015 is no longer influenced by the depressing force. Under this circumstance, the first magnetic element 4014 is magnetically attracted by the second magnetic element 4015, and thus the first magnetic element 4014 is moved upwardly. Consequently, the plural bulges 4011C of the keycap 4011 are moved from the second ends of the corresponding inclined guiding recesses 4013B to the first ends of the corresponding inclined guiding recesses 4013B, and the keycap 4011 is returned to its original position.

Please refer to FIGS. 6 and 7 again. In accordance with a second distinguished item, the luminous keyboard device 4 of this embodiment further comprises the light-shading plate 46 but does not comprises the reflecting plate. The light-shading plate 46 is disposed on the light guide plate 45. The plural light beams B from the plural light-emitting elements 43 are blocked by the light-shading plate 46. Consequently, the plural light beams B can be reflected back to the light guide plate 45 by the light-shading plate 46. A part of the light-shading plate 46 is in close contact with the connecting element 4013 of the keypad module 40 to form plural second bent structures 461. The portions of the plural light beams B that are directed to the light-shading plate 46 are reflected back to the light guide plate 45 by the plural second bent structures 461. Moreover, the light-shading plate 46 comprises plural second openings 462. The plural second openings 462 are aligned with the plural light-guiding structures 452 and disposed over the plural light-guiding structures 452, respectively. The portions of the plural light beams B guided by the plural light-guiding structures 452 are transmitted through the plural second openings 462. In this embodiment, the plural light-guiding structures 452 of the light guide plate 45 are texturing structures.

In accordance with a third distinguished item, the plural receiving parts 411 of the supporting plate 41 are protrusion structures. The protrusion structures are produced by stamping the supporting plate 41. The plural receiving parts 411 are downwardly-convex protrusion structures. Since the position of the supporting plate 41 is different from the position of the supporting plate 31 of the first embodiment, the supporting plate 41 of this embodiment has no openings. Moreover, the second reflective layer 47 is disposed on a top surface of the supporting plate 41 for reflecting the plural light beams B.

Fourthly, the positions of some components and the relationship between some components are distinguished. Please refer to FIGS. 6 and 7 again. From top to bottom, the keycap 4011, the frame body 4012, the connecting element 4013, the light-shading plate 46, the light guide plate 45, the flexible circuit board 42 and the supporting plate 41 of the luminous keyboard device 4 are sequentially shown. The switch circuit member 402 is arranged between the connecting element 4013 and the light-shading plate 46. The plural light-emitting elements 43 are non-inverted and disposed on a top surface of the flexible circuit board 42 (i.e. in a normal arrangement). Moreover, the first reflective layer 44 is formed on the top surface of the flexible circuit board 42 by printing a reflective material.

The optical paths of the plural light beams B from the plural light-emitting elements 43 will be illustrated as follows. When the luminous keyboard device 4 is driven and thus enabled, the plural light-emitting elements 43 emit the plural light beams B. The first portions of the plural light beams B are directly introduced into the light guide plate 45, and then guided by the plural light-guiding structures 452 of the light guide plate 45 to be directed upwardly. After the first portions of the plural light beams B are departed from the light guide plate 45, the first portions of the plural light beams B are sequentially transmitted through the plural second openings 462 of the light-shading plate 46, the light-transmissible switch circuit member 402 and the hollow connecting element 4013, and then directed to the plural light-outputting zones 4011A of the plural keycaps 4011. Consequently, the illuminating function is achieved. On the other hand, the second portions of the plural light beams B are reflected by the first reflective layer 44 on the first bent structure 421, and then introduced into the light guide plate 45. Then, the second portions of the plural light beams B are sequentially transmitted through the plural second openings 462, the switch circuit member 402 and the connecting element 4013, and directed to the plural light-outputting zones 4011A. The third portions of the plural light beams B are directed to the light-shading plate 46, and reflected back to the light guide plate 45 by the light-shading plate 46. Similarly, the third portions of the plural light beams B are sequentially transmitted through the plural second openings 462, the switch circuit member 402 and the connecting element 4013, and directed to the plural light-outputting zones 4011A. Moreover, the portions of the plural light beams B that are transferred within the light guide plate 45 and leaked from the light guide plate 45 are reflected back to the light guide plate 45 by the second reflective layer 47 on the supporting plate 41. Consequently, the light utilization efficiency is further enhanced.

Figure 9:
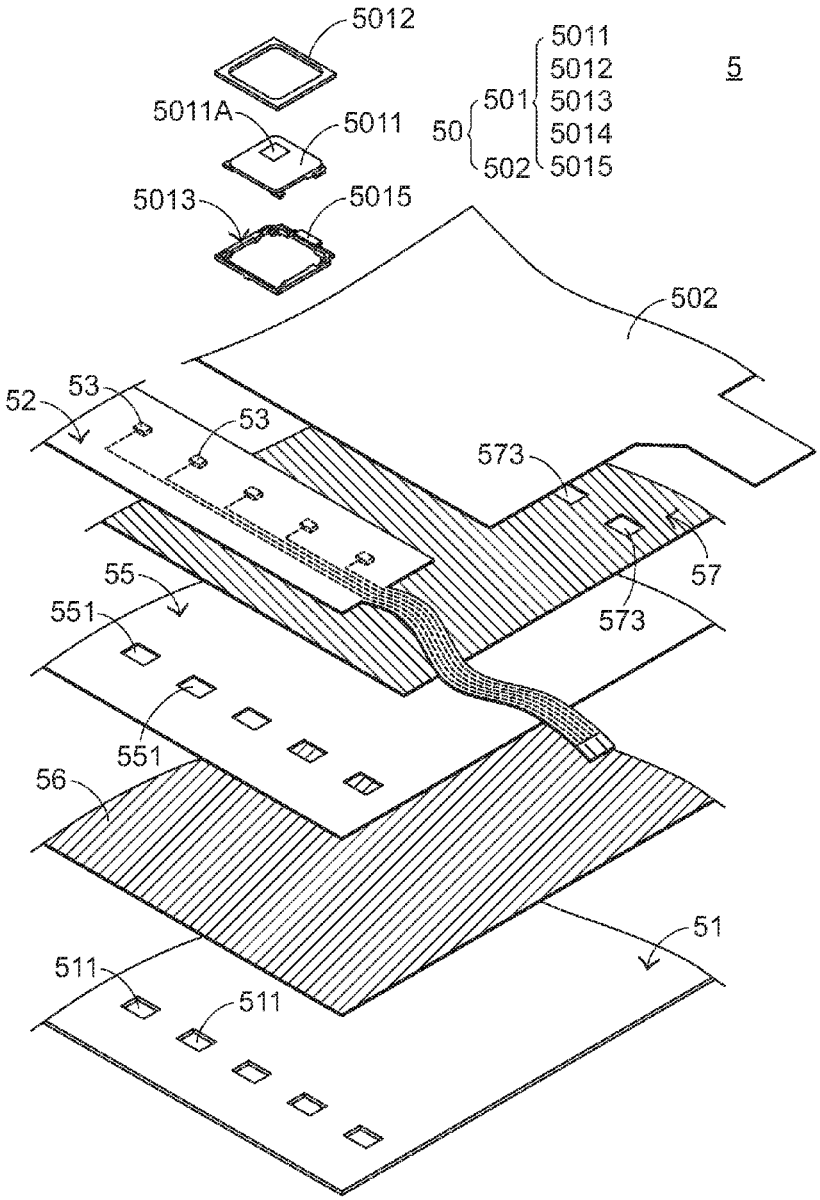
FIG. 9 is a schematic exploded view illustrating a portion of a luminous keyboard device according to a third embodiment of the present invention.
Figure 10:
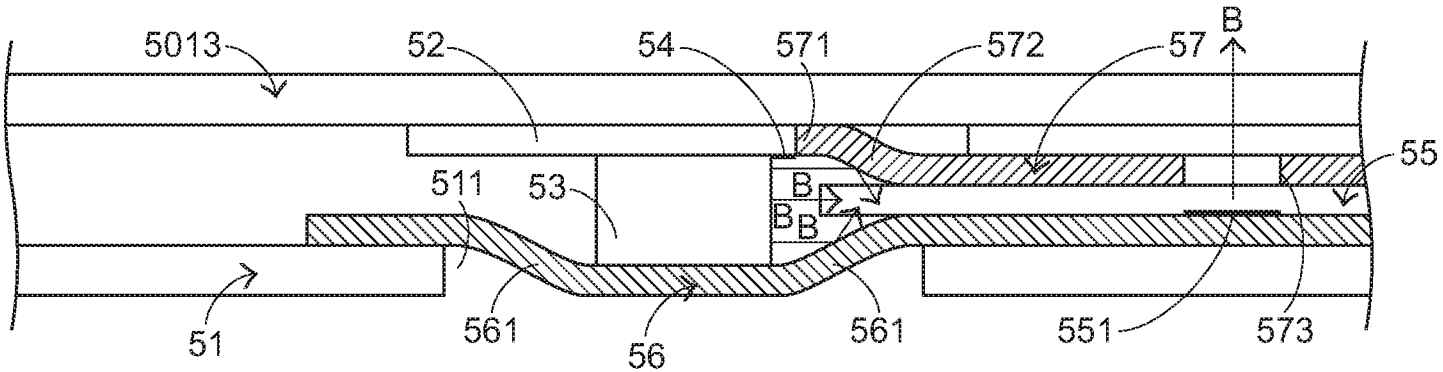
FIG. 10 is a schematic partial cross-sectional view illustrating the luminous keyboard device according to the third embodiment of the present invention.

The present invention further provides a luminous keyboard device according to a third embodiment of the present invention. FIG. 9 is a schematic exploded view illustrating a portion of a luminous keyboard device according to a third embodiment of the present invention. FIG. 10 is a schematic partial cross-sectional view illustrating the luminous keyboard device according to the third embodiment of the present invention. As shown in FIGS. 9 and 10, the luminous keyboard device 5 comprises a keypad module 50, a supporting plate 51, a flexible circuit board 52, plural light-emitting elements 53, a reflective layer 54, a light guide plate 55, a reflecting plate 56, and a light-shading plate 57. The keypad module 50 comprises plural keys 501 and a switch circuit member 502. In the keypad module 50, each of the keys 501 comprises a keycap 5011, a frame body 5012, a connecting element 5013, a first magnetic element 5014 (not shown), and a second magnetic element 5015. In this embodiment, the first magnetic element 5014 is a magnet, and the second magnetic element 5015 is a metal sheet, but is not limited thereto. Alternatively, in some other embodiments, the first magnetic element 5014 is a metal sheet, and the second magnetic element 5015 is a magnet. The structures and the operations of the keypad module 50 of this embodiment are substantially identical to those of the keypad module 40 of the second embodiment, and are not redundantly described herein.

The supporting plate 51 is disposed under the keypad module 50 for supporting the keypad module 50, the plural light-emitting elements 53, the light guide plate 55, the reflecting plate 56 and the light-shading plate 57. Moreover, the supporting plate 51 comprises plural receiving parts 511. The flexible circuit board 52 is disposed under the connecting element 5013, and contacted with the connecting element 5013. The flexible circuit board 52 is used for providing electric power to the plural light-emitting elements 53. The plural light-emitting elements 53 are disposed on a bottom surface of the flexible circuit board 52 and located near the plural receiving parts 511. By acquiring the electric power, the plural light-emitting elements 53 are driven to emit plural light beams B. The reflective layer 54 is disposed on the bottom surface of the flexible circuit board 52 for reflecting the plural light beams B. In this embodiment, the supporting plate 51 is made of a metallic material. The receiving part 511 is an opening, which is produced by a hole-breaking step. The light-emitting element 53 is a large-sized side-view light emitting diodes (e.g. the side-view light emitting diode having a thickness of 0.4 mm). Moreover, the reflective layer 54 is formed on the bottom surface of the flexible circuit board 52 by coating or printing a reflective material.

The light guide plate 55 is disposed under the flexible circuit board 52 for allowing the plural light beams B to go through and guiding the plural light beams B to be directed upwardly to the keypad module 50. Consequently, the plural light beams B are guided to the plural light-outputting zones 5011A of the plural keycaps 5011 to achieve the illuminating function. The light guide plate 55 comprises plural light-guiding structures 551. The plural light-guiding structures 551 are formed on a bottom surface of the light guide plate 55 for guiding the plural light beams B to the plural light-outputting zones 5011A of the plural keycaps 5011. Since the plural light-emitting elements 53 are located at a side of the light guide plate 55, it is not necessary to form openings in the light guide plate 55 in order to produce the receiving space for accommodating the plural light-emitting elements 53. Consequently, the directions of projecting the light beams B from the plural light-emitting elements 53 are the same. In this embodiment, the light guide plate 55 is a thinner light guide plate with a thickness of about 0.15 mm, the light-guiding structures 552 are light-guiding ink layers.

The light-shading plate 57 is arranged between the connecting element 5013 of the keypad module 50 and the light guide plate 55, and contacted with the flexible circuit board 52. The light-shading plate 57 is used for blocking the plural light beams B. A first end 571 of the light-shading plate 57 is in close contact with a bottom surface of the connecting element 5013 to form a first bent structure 572. The first bent structure 572 is aligned with the plural receiving parts 511. The light-shading plate 57 comprises plural first openings 573. The plural first openings 573 are aligned with the plural light-guiding structures 551, and disposed over the plural light-guiding structures 551, respectively. The plural light beams B guided by the plural light-guiding structures 552 are transmitted through the plural first openings 573. The reflecting plate 56 is disposed under the light guide plate 55 for reflecting the portions of the plural light beams B that are not introduced into the light guide plate 55. Consequently, the reflected portions of the plural light beams B are introduced into the light guide plate 55 again. Moreover, a part of the reflecting plate 56 is inserted into the plural receiving parts 511 and contacted with the plural receiving parts 511 to form plural second bent structures 561. The portions of the plural light beams B that are directed to the reflecting plate 56 are reflected back to the light guide plate 55 by the plural second bent structures 561.

After the supporting plate 51, the flexible circuit board 52, the plural light-emitting elements 53, the reflective layer 54, the light guide plate 55, the reflecting plate 56 and the light-shading plate 57 are combined together, the resulting structure of the luminous keyboard device is shown in FIG. 10. The plural light-emitting elements 53 are inverted and disposed on a bottom surface of the flexible circuit board 52. For clarification and brevity, only one light-emitting element 53 is shown in FIG. 10. Moreover, the thickness of the light guide plate 55 (0.15 mm) is smaller than the thickness of the light-emitting element 53 (0.4 mm).

The operating principles of depressing the keycaps 5011 to trigger the switch circuit member 502 to generate the key signals are similar to those of the second embodiment, and are not redundantly described herein. The illumination of the luminous keyboard device 3 will be illustrated as follows. Please refer to FIG. 10. When the luminous keyboard device 5 is driven and thus enabled, the plural light-emitting elements 53 emit the plural light beams B. The first portions of the plural light beams B are directly introduced into the light guide plate 55, and then guided by the plural light-guiding structures 551 of the light guide plate 55 to be directed upwardly. After the first portions of the plural light beams B are departed from the light guide plate 55, the first portions of the plural light beams B are sequentially transmitted through the plural first openings 573 of the light-shading plate 57, the switch circuit member 502 and the connecting element 5013, and then directed to the plural light-outputting zones 5011A of the plural keycaps 5011. Consequently, the illuminating function is achieved. On the other hand, the second portions of the plural light beams B are directed to the flexible circuit board 52 and the light-shading plate 57, reflected by the reflective layer 54 and the first bent structure 572, and then introduced into the light guide plate 55. Then, the second portions of the plural light beams B are sequentially transmitted through the plural first openings 573, the switch circuit member 502 and the connecting element 5013, and directed to the plural light-outputting zones 5011A. The third portions of the plural light beams B are directed to the reflecting plate 56, and reflected back to the light guide plate 55 by the reflecting plate 56. Similarly, the third portions of the plural light beams B are sequentially transmitted through the plural first openings 573, the switch circuit member 502 and the connecting element 5013, and directed to the plural light-outputting zones 5011A.

From the above descriptions, the present invention provides a luminous keyboard device. The luminous keyboard device of the present invention utilizes thicker light-emitting elements. Consequently, the luminous efficiency of the light beams from the light-emitting elements will be enhanced. Moreover, the supporting plate comprises plural receiving part for accommodating the thicker light-emitting elements. The reflective layer (on the flexible circuit board), the light-shading plate or the reflecting plate is disposed around the light-emitting elements for reflecting the light beams that are emitted by the light-emitting elements. Consequently, the light beams can be introduced into the light guide plate and directed to the plural light-outputting zones of the keypad module. Under this circumstance, the luminous efficiency of the luminous keyboard device is slightly increased. Moreover, since the light beams emitted by the light-emitting elements are not leaked out, the light utilization efficiency is further enhanced. Moreover, the luminous keyboard device of the present invention may use a thinner light guide plate in order to meet the requirement of slimness. Moreover, the uses of the thicker light-emitting elements can increase the luminous efficiency and reduce the cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all modifications and similar structures.

What is claimed is:

1. A luminous keyboard device, comprising:

a keypad module exposed to a top surface of the luminous keyboard device;

a supporting plate disposed under the keypad module and supporting the keypad module, wherein the supporting plate comprises at least one receiving part;

a flexible circuit board disposed under the keypad module and providing electric power, wherein the flexible circuit board is contacted with the at least one receiving part, and the flexible circuit board has at least one first bent structure corresponding to the at least one receiving part;

at least one light-emitting element disposed on the flexible circuit board and located near the at least one receiving part, wherein by acquiring the electric power, the at least one light-emitting element is driven to emit at least one light beam;

a reflective layer disposed on the flexible circuit board and reflecting the at least one light beam; and a light guide plate disposed under the keypad module, and allowing the at least one light beam to go through and guide the at least one light beam to the keypad module, wherein the light guide plate is thinner than each of the at least one light-emitting element, wherein a first portion of the at least one light beam is directly introduced into the light guide plate, and a second portion of the at least one light beam is reflected by the reflective layer on the at least one first bent structure and then introduced into the light guide plate.

2. The luminous keyboard device according to claim 1, wherein the flexible circuit board is disposed under the supporting plate and disposed over the light guide plate, wherein the at least one light-emitting element and the reflective layer are disposed on a bottom surface of the flexible circuit board.

3. The luminous keyboard device according to claim 2, further comprising a reflecting plate, wherein the reflecting plate is disposed under the light guide plate and reflects the at least one light beam, so that the at least one light beam is reflected back to the light guide plate.

4. The luminous keyboard device according to claim 2, wherein the keypad module comprises:

plural keys exposed to the top surface of the luminous keyboard device, wherein each of the plural keys comprises:

a keycap exposed to the top surface of the luminous keyboard device, wherein the keycap comprises a light-outputting zone, wherein after the at least one light beam is guided by the light guide plate, the at least one light beam is transmitted through the light-outputting zone;

a connecting element arranged between the supporting plate and the keycap, wherein by the connecting element, the supporting plate and the keycap are connected with each other, and the keycap is movable upwardly and downwardly relative to the supporting plate; and an elastic element disposed under the keycap for providing an elastic force to the keycap, wherein the keycap is returned to an original position in response to the elastic force; and a switch circuit member arranged between the supporting plate and the plural keys, wherein when the switch circuit member is triggered by the plural keys, plural key signals are correspondingly generated.

5. The luminous keyboard device according to claim 4, wherein the switch circuit member comprises:

an upper wiring board having plural upper contacts;

a spacer layer disposed under the upper wiring board, and having plural perforations corresponding to the plural upper contacts, wherein when the switch circuit member is depressed, a corresponding upper contact is inserted into a corresponding perforation; and a lower wiring board disposed under the spacer layer, and having plural lower contacts corresponding to the plural upper contacts, wherein the plural lower contacts and the plural upper contacts are collectively defined as plural key switches.

6. The luminous keyboard device according to claim 1, wherein the flexible circuit board is arranged between the supporting plate and the keypad module and disposed under the light guide plate, wherein the at least one light-emitting element and the reflective layer are disposed on a top surface of the flexible circuit board.

7. The luminous keyboard device according to claim 6, wherein the luminous keyboard device further comprises a light-shading plate, and the light-shading plate is disposed on the light guide plate, wherein the at least one light beam is blocked by the light-shading plate, so that the at least one light beam is reflected back to the light guide plate by the light-shading plate, wherein a part of the light-shading plate is in close contact with the keypad module to form at least one second bent structure, wherein a third portion of the at least one light beam is reflected by the at least one second bent structure and then introduced into the light guide plate.

8. The luminous keyboard device according to claim 6, wherein the keypad module comprises:

plural keys exposed to the top surface of the luminous keyboard device, wherein each of the plural keys comprises:

a keycap exposed to the top surface of the luminous keyboard device, wherein the keycap comprises a light-outputting zone, wherein after the at least one light beam is guided by the light guide plate, the at least one light beam is transmitted through the light-outputting zone;

a frame body contacted with the keycap, wherein the frame body stops the keycap to prevent detachment of the keycap from the frame body;

a connecting element disposed under the frame body and contacted with the keycap, wherein by the connecting element, the keycap is movable upwardly and downwardly relative to the frame body;

a first magnetic element disposed on the keycap; and a second magnetic element disposed on the connecting element, wherein in response to a magnetic force generated by the second magnetic element and the first magnetic element, the keycap is returned to an original position; and a switch circuit member disposed under the connecting element, wherein when the switch circuit member is triggered by the second magnetic element, plural key signals are correspondingly generated.

9. The luminous keyboard device according to claim 1, wherein the light guide plate comprises:

at least one first opening formed in the light guide plate and aligned with the at least one receiving part, wherein the at least one first opening and the at least one receiving part are collaboratively defined as at least one receiving space, and the at least one light-emitting element is accommodated within the at least one receiving space; and plural light-guiding structures formed on a bottom surface of the light guide plate, wherein the at least one light beam is guided to the keypad module by the plural light-guiding structures.

10. The luminous keyboard device according to claim 9, wherein the supporting plate further comprises plural second openings, wherein the plural second openings are formed in the supporting plate, wherein after the at least one light beam is guided by the plural light-guiding structures, the at least one light beam is directed to the keypad module through the plural second openings.

11. The luminous keyboard device according to claim 1, wherein the receiving part is a third opening, a first protrusion structure, or a second protrusion structure with a fourth opening, wherein a bending angle of the at least one bent structure of the flexible circuit board is determined according to the third opening, the first protrusion structure or the second protrusion structure with the fourth opening, wherein the supporting plate is made of a metallic material.

12. A luminous keyboard device, comprising:

a keypad module exposed to a top surface of the luminous keyboard device;

a supporting plate disposed under the keypad module and supporting the keypad module, wherein the supporting plate comprises at least one receiving part;

a flexible circuit board disposed under the keypad module and contacted with the keypad module, wherein the flexible circuit board provides electric power;

at least one light-emitting element disposed on the flexible circuit board and disposed over the at least one receiving part, wherein by acquiring the electric power, the at least one light-emitting element is driven to emit at least one light beam;

a light guide plate arranged between the keypad module and the supporting plate, and allowing the at least one light beam to go through and guide the at least one light beam to the keypad module; and a light-shading plate arranged between the keypad module and the light guide plate and contacted with the flexible circuit board, wherein the at least one light beam is blocked by the light-shading plate, wherein a part of the light-shading plate is in close contact with the keypad module to form at least one first bent structure corresponding to the at least one receiving part, wherein the light guide plate is thinner than each of the at least one light-emitting element, wherein a first portion of the at least one light beam is directly introduced into the light guide plate, and a second portion of the at least one light beam is reflected by the at least one first bent structure and then introduced into the light guide plate.

13. The luminous keyboard device according to claim 12, further comprising a reflecting plate, wherein the reflecting plate is disposed under the light guide plate and reflects the at least one light beam, wherein a part of the reflecting plate is inserted into the at least one receiving part to form at least one second bent structure, wherein a third portion of the at least one light beam is reflected by the at least one second bent structure and then introduced into the light guide plate.

14. The luminous keyboard device according to claim 13, wherein the receiving part has a third opening, wherein a bending angle of the at least one second bent structure of the reflecting plate corresponding to the third opening is determined according to the third opening, wherein the supporting plate is made of a metallic material.

15. The luminous keyboard device according to claim 12, further comprising a reflective layer, wherein the reflective layer is formed on a bottom surface of the flexible circuit board and reflects the at least one light beam, so that the at least one light beam is reflected back to the light guide plate.

16. The luminous keyboard device according to claim 12, wherein the keypad module comprises:

plural keys exposed to the top surface of the luminous keyboard device, wherein each of the plural keys comprises:

a keycap exposed to the top surface of the luminous keyboard device, wherein the keycap comprises a light-outputting zone, wherein after the at least one light beam is guided by the light guide plate, the at least one light beam is transmitted through the light-outputting zone;

a frame body contacted with the keycap, wherein the frame body stops the keycap to prevent detachment of the keycap from the frame body;

a connecting element disposed under the frame body and contacted with the keycap, wherein by the connecting element, the keycap is movable upwardly and downwardly relative to the frame body;

a first magnetic element disposed on the keycap; and a second magnetic element disposed on the connecting element, wherein in response to a magnetic force generated by the second magnetic element and the first magnetic element, the keycap is returned to an original position; and a switch circuit member disposed under the connecting element, wherein when the switch circuit member is triggered by the second magnetic element, plural key signals are correspondingly generated.

17. The luminous keyboard device according to claim 12, wherein the light guide plate comprises:

at least one first opening formed in the light guide plate and aligned with the at least one receiving part, wherein the at least one first opening and the at least one receiving part are collaboratively defined as at least one receiving space, and the at least one light-emitting element is accommodated within the at least one receiving space; and plural light-guiding structures formed on a bottom surface of the light guide plate, wherein the at least one light beam is guided to the keypad module by the plural light-guiding structures.

* * * * *